United States Patent [19]

Baker

[11] 4,319,713

[45] Mar. 16, 1982

[54] STOVE BLOWER CONTROL ACCESSORY

[75] Inventor: Roy D. Baker, Brooklyn, Mich.

[73] Assignee: Eagle-Picher Industries, Inc., Cincinnati, Ohio

[21] Appl. No.: 222,569

[22] Filed: Jan. 5, 1981

[51] Int. Cl.[3] ..... F24H 3/10

[52] U.S. Cl. ..... 236/96; 126/110 B; 236/11; 236/38

[58] Field of Search ..... 236/11, 38, 95, 96; 126/110 B

[56] References Cited

U.S. PATENT DOCUMENTS

| | | | |
|---|---|---|---|
| 1,436,267 | 11/1922 | Lennig . | |
| 2,188,542 | 1/1940 | Larson . | |
| 2,388,829 | 11/1945 | Cheasley . | |
| 2,856,508 | 10/1958 | Kueser . | |
| 3,921,899 | 11/1975 | Hamilton | 236/11 X |
| 3,985,295 | 10/1976 | Monninger | 236/38 |
| 4,111,182 | 9/1978 | Roberts et al. | 126/66 X |
| 4,120,281 | 10/1978 | Wass | 126/121 |
| 4,140,101 | 2/1979 | Glover | 126/110 B |

*Primary Examiner*—William E. Tapolcai, Jr.
*Attorney, Agent, or Firm*—Wood, Herron & Evans

[57] ABSTRACT

A temperature responsive blower control attachment for a wood-burning stove. The attachment is mountable to or seatable on a heated external surface of the stove and provides thermostatically regulated operation of an electrically operated blower or fan that circulates air heated by the stove. Temperature is sensed through an element which is in contact with the heated surface of the stove, but the other circuit elements of the attachment are isolated from and are not subjected to the potentially damaging temperature of the stove surface.

5 Claims, 3 Drawing Figures

STOVE BLOWER CONTROL ACCESSORY

FIELD OF THE INVENTION

This device relates to an accessory control for use with a wood-burning stove, for regulating an electric blower or fan that circulates air heated by the stove.

BACKGROUND

Wood-burning stoves are sometimes provided with an electric blower to improve the circulation of heated air from the stove into the room. Many wood-burning stoves in use today have such blowers, but have no thermostatic means for blower control, that is, no means to insure that the blower operates only when the furnace is at a suitable heating temperature. Absent such control, the blower will circulate cool air when the fire has just been started and also when the fire is out, unless it is manually turned off.

BRIEF DESCRIPTION OF THE INVENTION

In accordance with this invention a blower control is provided which can be externally mounted as an attachment to a wood-burning stove to regulate the operation of an electric blower inside the stove or to regulate the operation of an external fan that blows room air over the stove. (As used hereinafter, "blower" is used in a generic sense, as including an external fan as well as a blower within the stove.) The control includes a thermostatic device which senses an external "skin temperature" of the stove at a position on the stove which reflects the temperature of the air within the stove. Also included is a rheostat for controlling blower speed, and a plug socket into which the blower's electric cord can be connected. The control has a cord for plug-in connection to a power source. A thermostat element of the control completes the circuit and applies power to the blower only when the sensed stove skin temperature exceeds a pre-established minimum.

The outside surface of a wood-burning stove can become quite hot, as high as 500° F. or more under some conditions. Prolonged exposure to high temperatures can damage the electrical circuit components, e.g., the rheostat or the electrical socket of the control, or the electric cord itself. Even though the control is seated on the outside of the stove and engages only the external surface of the stove, it has been found advantageous to isolate the control body from the high temperature of the stove. The invention accomplishes this by providing a mounting for the control which includes one or more spacers that position the body of the housing away from the stove and which provide an air space or gap between the control housing and the stove surface on which the "skin temperature" is measured. While the thermally damagable elements of the control are thus effectively separated from the hot stove surface, the thermostatic element itself is mounted between or adjacent to the spacers, to project from the housing a distance approximately equal to the projection of the spacers so that the heat receiving surface of the thermostat is in close proximity to, and is effectively in thermal contact with, the hot stove surface. By way of further protection against the high temperature, cooling louvers are desirably provided in the control housing.

DETAILED DESCRIPTION OF THE DRAWINGS

The invention can best be further described by reference to the accompanying drawings in which.

Figure 1:
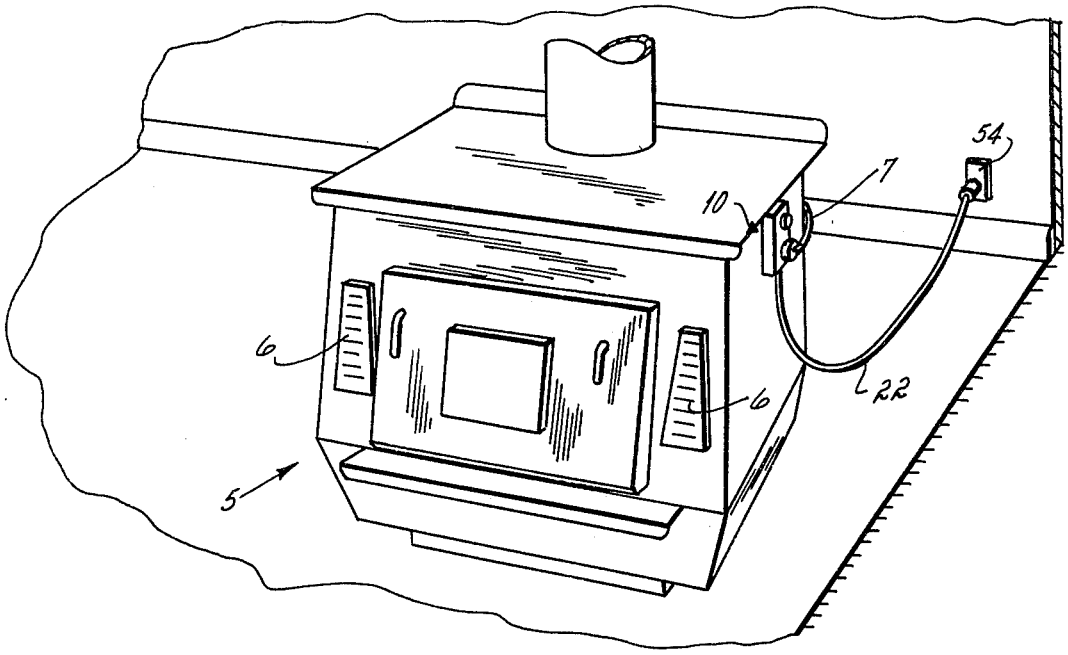
FIG. 1 is a perspective view of a wood-burning stove with a preferred embodiment of the temperature responsive blower control attachment of this invention mounted to one side of the stove.

For purposes of further description, the invention is shown in a preferred embodiment wherein the control is removably mounted on a bracket which is in turn secured to the side of an otherwise conventional wood-burning stove. The stove, denoted generally by 5, has a built-in internal electric blower, not shown. Current is supplied to the blower through an electric cord 7 which leads from the control. The blower is usually positioned in a hot air plenum or a duct of the stove, and blows air into the room via outlet ports 6,6.

The control is indicated generally at 10 and may be positioned on the side of the stove as shown, adjacent to the stove hot air plenum or outlet duct; or it may sit on the top of the stove. The side mounting shown is preferred because it better keeps the line cords away from contact with the stove surface. Air within the stove heats the stove outside wall to a temperature which generally reflects the temperature of the air inside the stove, although the stove outside surface temperature will be somewhat lower than the air temperature.

Control 10 includes a two-part housing which may be of sheet metal, comprising an inverted box-like body portion 12 and a shallow bottom closure 14 which fits inside body 1 and is secured to it as by screw 15 and a tab 16.

On the outer surface of body portion 12, an electrical socket 20 is mounted, which in use receives a plug in blower cord 7. The socket may be of thermoset plastic; the spacing and cooling means protects against thermal degradation. A line plug 22 leads from the control housing for connection to an electrical wall socket in the room in which the stove is located.

Control 10 preferably includes a blower rate-adjusting means such as the rheostat indicated generally at 24, which controls the potential applied to blower. The rheostat 24 includes a winding indicated diagrammatically at 26 within control body 12, and a knob 28 for adjusting blower speed between "low" and "high" rates and an "off" position.

The control further includes thermostatic means indicated at 30. This means 30 is mounted in the base or closure 14 of the control and projects outwardly from the base, toward the stove surface. Thermostatic means 30 has a heat receiving face 32 that is generally parallel to but spaced outwardly from closure 14. When the control is in place on the stove, heat receiving face 32 of the thermostat is in thermal contact with, i.e., closely proximate to the metal wall of the stove, and responds to its temperature. When the temperature receiving surface 32 is at a pre-established temperature, thermostat 30 completes a circuit connection to provide power to the blower from the power source, via line cord 7 to the blower. One example of a suitable thermostatic element 30 is that sold by Thermo-O-Disc Inc. For example, that particular device closes (i.e., energizes) the blower when sensed temperature exceeds about 111° F. and opens the circuit when its temperature drops below about 91° F.

In order to minimize the transfer of heat from the stove to the heat damagable elements of control 10, the control housing is spaced from the stove surface 39 by spacer means, as at 40, 40 in the embodiment shown, which establish an air gap 42 between the base 14 of the control and the stove's surface. The dimension of the gap may be as little as $\frac{3}{8}''$, yet it will still provide effective protection against heat degradation.

In the preferred embodiment shown, the spacers 40, 40 are formed as upstanding legs on a bracket 44 which is secured to the stove sidewall as by bolts 46, 46. These legs 40, 40 have upturned tabs 50, 50 at their outer ends, which tabs are engaged in slots 52, 52 formed in the control base 14. The small size of the tabs minimizes heat conduction through them to the housing. The control is thereby removably secured to the stove so that it is securely positioned, but can be removed for service. It will be apparent that other types of mountings can be used, for example the mounting can be held in place by magnetic attraction.

Figure 2:
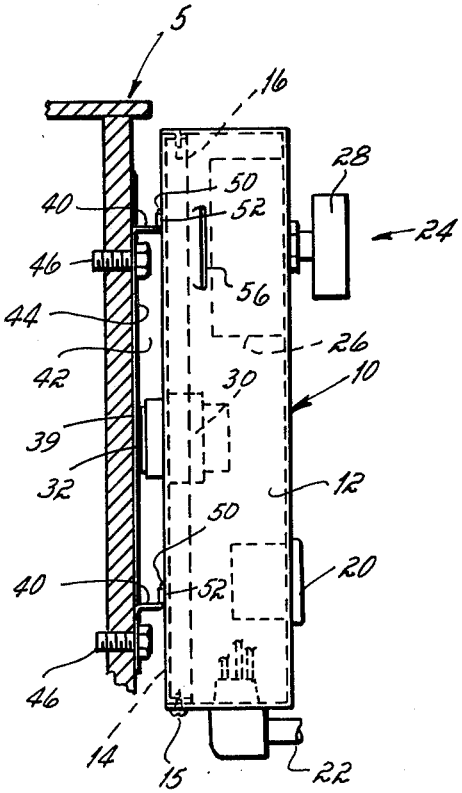
FIG. 2 is a side elevational view of the temperature responsive blower control, particularly illustrating the preferred bracket by which it is attached to the stove.
Figure 3:
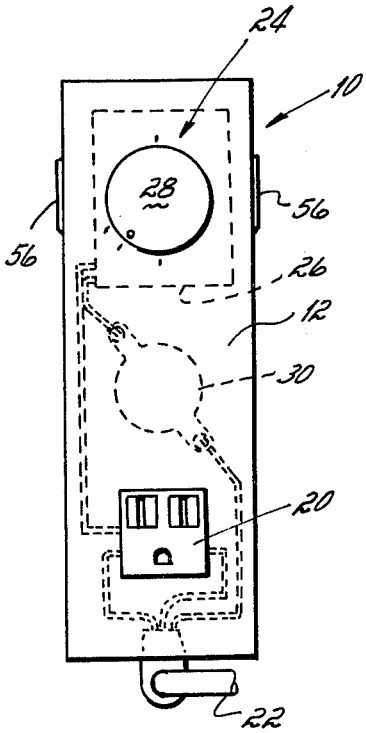
FIG. 3 is a front view of the temperature responsive blower control.

As can be seen in FIG. 2, the spacers 44 position the control base from the stove surface by a spacing which is essentially equal to the projection of the thermostatic face 32 from the base; thus the thermostat is effectively in thermal contact with the stove surface (in the embodiment shown, through the metal bracket 44). It will be appreciated that the spacers or legs can be integral with the control base, rather than on a separate bracket. Louvers or air slots 56, 56 are desirably provided in the side of control body, adjacent the rheostat, for air circulation and for escape of heated air from inside the control housing.

In use, the blower is connected through control socket 20 and the control line cord 22, to wall socket 54. Rheostat 24 can be set at a predetermined position, corresponding, say, to minimum blower speed. When the stove surface 39 reaches the thermostat close temperature, the blower energizing circuit connection is made and blower operation is started. The blower operates so long as the air temperature remains above the thermostat open temperature; and when the fire has cooled so that the skin temperature, as reflected at the thermostat face, no longer exceeds that minimum, the blower operation is stopped. The provision of the air space between the body of the control and the stove surface, but with the sensor face in thermal engagement with the stove's surface, prevents hot stove surface temperatures from damaging the control circuit components.

Having described the invention, what is claimed is:

1. A thermostatic control for an electric blower that circulates air heated by a stove, said control including, a housing mounting thermostatic means having a temperature receiving face which is positioned outwardly of said housing, said housing also mounting a rheostat for controlling the blower speed, an electric socket for receiving an electric plug from the blower, and circuit means including said thermostatic means and said plug for establishing an electrical circuit between the blower plug and an external source of power when the temperature receiving face of said thermostatic means senses a temperature above a predetermined minimum, said control also including spacing means which in use is positioned between said housing and a heated surface of said stove, thereby to separate the housing from the stove surface and to provide an air space between the stove surface and the housing, said spacing means spacing the housing from the stove so that the temperature receiving face of the thermostatic means is in thermal engagement with said heated surface of said stove.

2. The thermostatic control of claim 1 further including a bracket for attachment to the stove surface, said bracket presenting said spacing means, said spacing means being removably connectable to said housing.

3. The thermostatic control of claim 2 wherein said spacing means comprise tabs which are engageable with means on the housing, to position the control with respect to the stove surface.

4. The thermostatic control of claim 3 wherein said temperature receiving face of said thermostatic means is in thermal engagement with said stove surface through said bracket.

5. The thermostatic control of claim 4 wherein said housing is louvered adjacent said rheostat to provide air circulation inside the housing.

* * * * *